United States Patent [19]

Young et al.

[11] Patent Number: 4,598,829

[45] Date of Patent: Jul. 8, 1986

[54] HYDRAULIC CIRCUIT FOR CRANE

[75] Inventors: Rickie A. Young; David L. Willard; Gerald P. Berger, all of Cedar Rapids, Iowa

[73] Assignee: FMC Corporation, Chicago, Ill.

[21] Appl. No.: 746,944

[22] Filed: Jun. 20, 1985

Related U.S. Application Data

[63] Continuation of Ser. No. 508,972, Jun. 29, 1983, abandoned.

[51] Int. Cl.[4] ..... B66C 13/18

[52] U.S. Cl. ..... 212/149; 212/151; 212/159

[58] Field of Search ..... 212/149, 151, 153, 159, 212/162, 163, 174, 229, 190–192, 211, 206, 223, 227, 230–232, 237, 239, 262

[56] References Cited

U.S. PATENT DOCUMENTS

| | | | |
|---|---|---|---|
| 2,030,529 | 2/1936 | Nash | 212/153 |
| 3,094,221 | 6/1963 | Galuska | 212/151 |
| 3,334,756 | 8/1967 | Whitmire | 212/151 |
| 3,561,610 | 2/1971 | Buckert et al. | 212/151 |
| 3,606,049 | 9/1971 | Gordon | 214/138 |
| 3,814,265 | 6/1974 | Miller | 212/149 |
| 4,157,736 | 6/1979 | Carbert | 212/153 |
| 4,236,864 | 12/1980 | Couture et al. | 212/151 |
| 4,344,497 | 8/1982 | Rathi et al. | 212/231 |

FOREIGN PATENT DOCUMENTS

| | | | |
|---|---|---|---|
| 23884 | 2/1956 | Fed. Rep. of Germany | 212/153 |
| 1139257 | 11/1962 | Fed. Rep. of Germany | 212/151 |
| 149792 | 7/1981 | German Democratic Rep. | 212/149 |
| 69355 | 6/1978 | Japan | 212/149 |
| 217524 | 6/1924 | United Kingdom | 212/149 |
| 1450852 | 9/1976 | United Kingdom | 173/11 |
| 232490 | 12/1968 | U.S.S.R. | 212/149 |
| 449872 | 4/1975 | U.S.S.R. | 212/149 |

*Primary Examiner*—Trygve M. Blix
*Assistant Examiner*—R. B. Johnson
*Attorney, Agent, or Firm*—Ronald C. Kamp; Richard B. Megley

[57] ABSTRACT

A hydraulic circuit for a crane having both lift and boom hoist pumps driven by the same engine with appropriate control valves to independently control the lift hooks and the boom angle. An unloading valve is interposed in the boom hoise circuit and dumps the boom hoise pump directly to reservoir when the pressure in the left pump circuit becomes excessive. A boom limit valve, actuated as the boom reaches both upper and lower limits, also causes the unloading valve to dump the boom hoise pump to reservoir.

2 Claims, 3 Drawing Figures

HYDRAULIC CIRCUIT FOR CRANE

This application is a continuation, of application Ser. No. 508,972, filed 06-29-83, now abandoned.

This invention relates to hydraulic circuits for cranes, and more particularly, to such circuits for preventing stalling of the engine under severe load conditions.

The present invention provides a hydraulic circuit for a crane, especially an offshore crane, to prevent the engine from stalling when subjected to worst-case load conditions. The crane's engine is sized, in terms of horsepower, to deliver only enough power to operate the crane under those loads normally anticipated. Operating all of the crane functions, i.e., swing, boom winch and hook winches, simultaneously, would require a large engine resulting in an economic waste under normal conditions. To protect an appropriately sized engine from stalling when subjected to overload conditions, the present invention provides a circuit which automatically diverts hydraulic power from one of the pumps being driven by the engine to the reservoir, thereby reducing the load on the engine and preventing it from stalling. In addition, a boom limit device is provided which utilizes the characteristics of the unloading circuit to prevent inadvertent movement of the boom to an angle which would cause damage to the crane.

The drawings are briefly described as follows.

Figure 1:
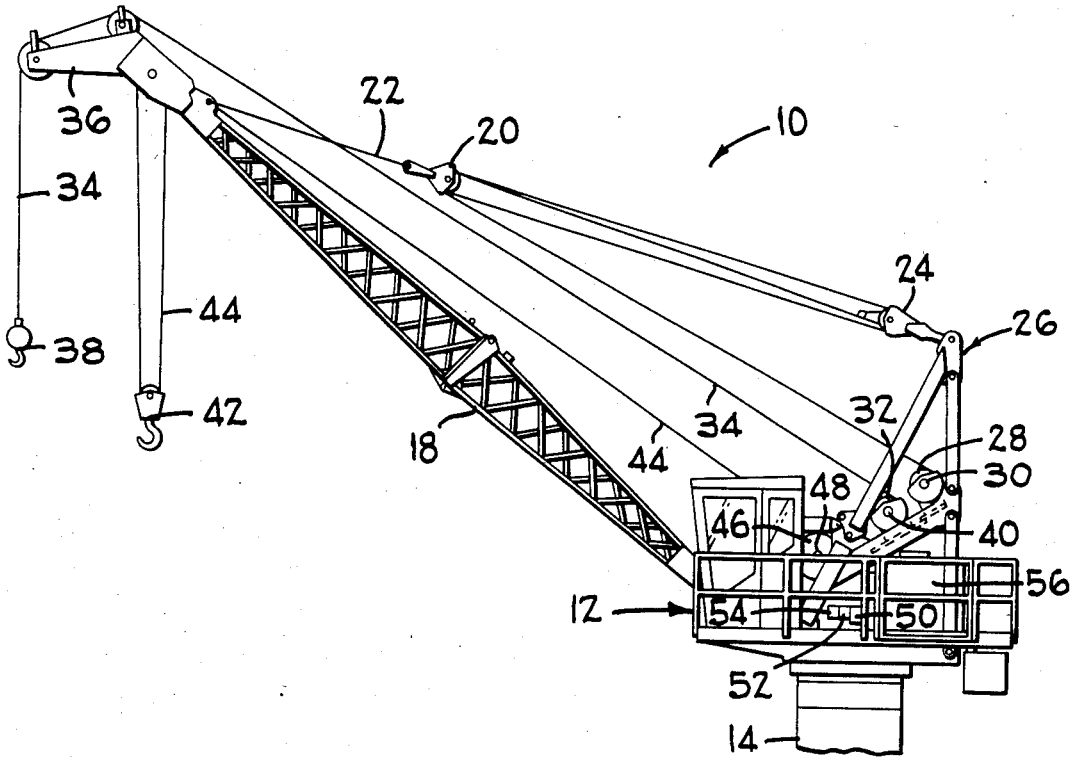
FIG. 1 is a side elevational view of a pedestal mount crane incorporating a hydraulic circuit according to the present invention.

Referring to FIG. 1, a pedestal mount crane, indicated generally at 10, has an upper works 12 swingably mounted on a pedestal 14 which may, for example, be secured to an offshore platform. The turntable between the upper works 12 and the pedestal 14 permits the swinging movement, i.e., rotation about a vertical axis, of the upper works 12 relative to the pedestal 14. A ring gear and pinion driven by a hydraulic swing motor provides the force for swinging in a convention manner. A boom 18 is pivotally attached to the upper works 12. The angular position of the boom 18 is controlled by a wire rope reeved between a multiple sheave bridle 20, which is attached to the boom tip by pendant 22, and a complementary sheave bail 24, which is pivotally attached to the top of an A-frame gantry 26, and wound on boom hoist or winch 28. The boom hoist 28 is mounted on the gantry 26 and driven by a hydraulic motor 30. An auxiliary hoist or winch 32 has a whip line or rope 34 wound thereon which extends over sheaves on a boom tip extension 36 and is secured to a hook 38. The winch 32 is also mounted on gantry 26 and is driven by a hydraulic motor 40. The main hook block 42 is supported by a wire rope 44 trained over a sheave or sheaves on the boom tip and wound on the main hoist or winch 46. The main winch 46 is also mounted on the gantry 26 and is driven by a hydraulic motor 48. Hydraulic fluid power for these motors is provided by three pumps, 50, 52 and 54 driven by an engine 56 on the upper works 12.

Figure 2:
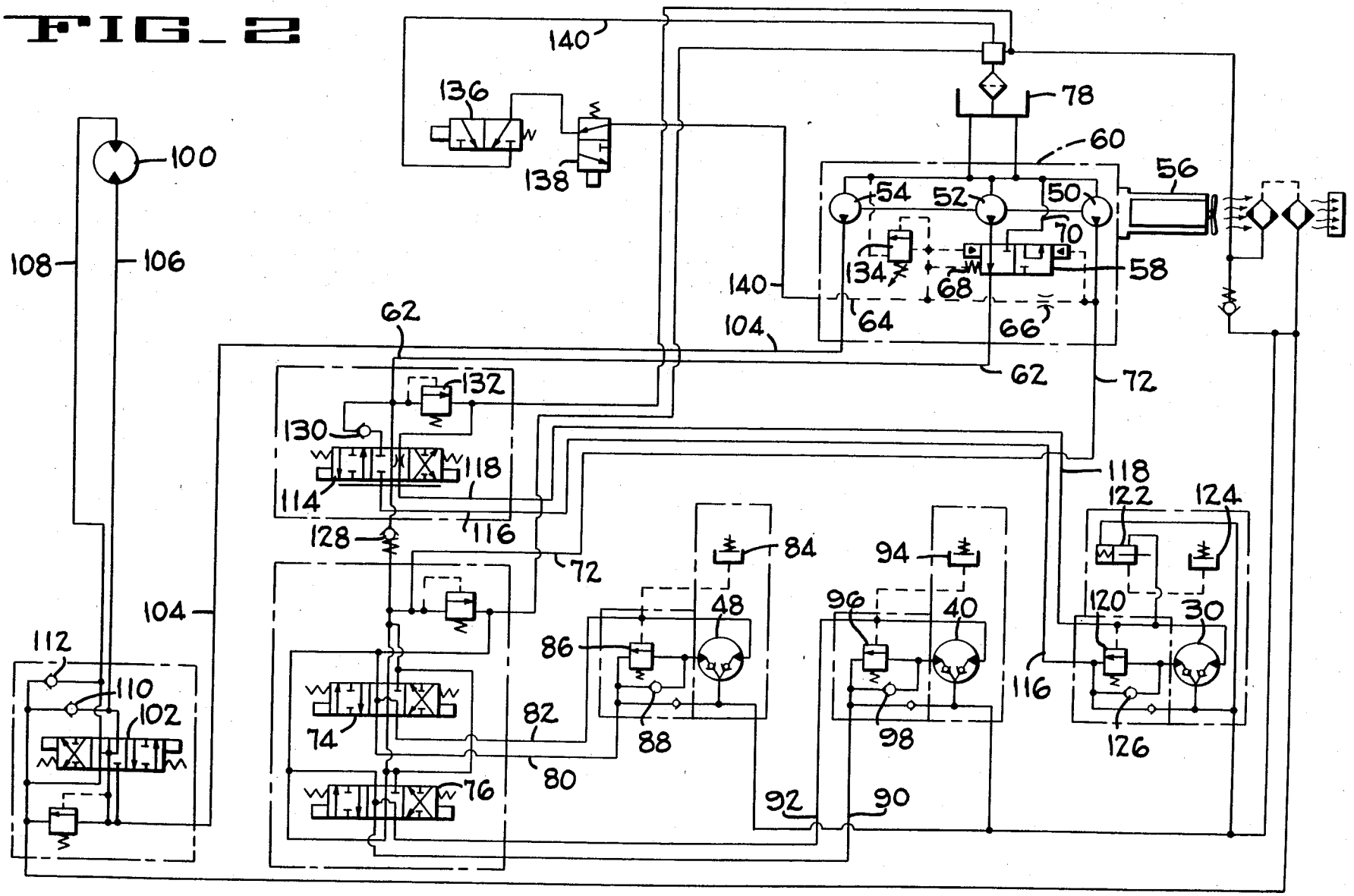
FIG. 2 is a schematic diagram of a hydraulic circuit according to the present invention.

Referring to FIG. 2, the engine 56 is shown schematically driving the three pumps or pump sections 50, 52 and 54 of an unloading pump with a pressure responsive unloading valve 58. The three pump sections 50, 52 and 54 and the unloading valve 58, and its associated circuitry, is commercially available as a unit, such as that sold by Tyrone Hydraulics, Inc. as their NSH Series Pump with Pressure Sensitive Unloading Valve, for example. The unit 58 is indicated by block 60 FIG. 2, with internal pilot passages indicated by dotted lines. The unloading valve 58 normally remains in the position shown, in which pressure flow from the pump 52 is discharged into conduit 62. However, whenever flow is established through pilot passage 64,, a pressure drop occurs across orifice 66. The force of pressure on the right side (acting to the left) of unloading valve 58 will exceed the combined force of pressure and compression spring on the left (acting to the right), causing the valve 58 to shift to the left. The shifted position of valve 58 will cause the output of pump 52 to be diverted to reservoir through conduit 70. The operation of this unloading valve in relation to the boom hoist circuit will be explained hereinafter.

The output of main pump 50 is directed through conduit 72 to a pair of open center, double acting hydraulic valves 74 and 76. The valve 74 controls the main winch hydraulic motor 48 by selectively directing pressure to and returning fluid to reservoir through conduits 80 and 82. A spring-applied, pressure-release brake 84 with a one way ratchet holds the winch from unwinding in the absence of pressure and is connected to the conduit 82 so that the brake is released when pressure is directed by valve 74 into conduit 82 to rotate hydraulic motor 48 in a direction to unwind the rope 44 thereon. A counterbalance valve 86 in conduit 80 is also opened by pressure in conduit 82 to permit return of hydraulic fluid to the reservoir 78. The valve 74 is shifted to direct pressure to conduit 80 to rotate hydraulic motor 48 in a direction to reel in the rope 44. A check valve 88 permits pressure to bypass the counterbalance valve 86 when the valve 74 is shifted to the left so that conduit 80 receives hydraulic fluid pressure from pump 50. The brake 84, in that situation, need not be released to reel in rope 44 since the one way ratchet incorporated into the brake 84 only prevents unwinding of the rope 44.

Conduits 90 and 92 connect the valve 76 to the motor 40 to control the auxiliary winch 32 in a similar manner. A counterbalance valve 96 in conduit 90 and a one way, spring applied brake 94 are connected to conduit 92, which is pressurized to unwind the rope 34 from the winch 32. A check valve 98 provides a bypass for counterbalance valve 98. The operation of the valve 76 to control hydraulic motor 40 is identical to that described in connection with valve 74 and motor 48.

The swing motor 100 for the turntable is controlled by swing valve 102 which receives hydraulic fluid pressure from pump 54 through conduit 104. Conduits 106 and 108 connect the valve 102 with the motor 100 and are selectively pressurized and connected to reservoir to determine the direction of swing of the upper 12 relative to the pedestal 14. A pair of check valves 110 and 112 permit makeup fluid to be drawn into conduits 106 and 108 respectively to prevent cavitation in the motor 100.

The boom hoist valve 114 received fluid pressure through conduit 62, but only when the unloading valve 58 is in the position shown in FIG. 2. The valve 114 is connected to the boom hoist hydraulic motor 30 by conduits 116 and 118. The conduit 118 is pressurized when the boom tip is to be lowered, i.e., when the rope is to be unwound from the winch 28. Pressure in conduit 118 is directed to counterbalance valve 120 to permit return of fluid to the reservoir through conduit 116. Simultaneously, pressure in conduit 118 pressurizes a pawl release cylinder 122 to disengage a pawl holding the winch 28 and a one-way or ratcheting, pressure-release brake 124. The boom will then be lowered. A check valve 126 permits pressure in conduit 116 to bypass the counterbalance valve 120 when valve 114 is shifted to the right to raise the boom tip. The spring-seated, check valve 128 permits the pressure flow supplied through conduit 62 to the valve 114 by pump 52 to be combined with the pressure flow from pump 50 to conduit 72 when the boom hoist valve 114 is shifted to the left and whenever the pressure in conduit 62 exceeds that in conduit 72 by a predetermined pressure differential when the boom hoist valve 114 is in the neutral position shown in FIG. 2. The main winch and auxiliary winch therefore, have a combined output of pumps 50 and 52 available at least a portion of the time for faster operation of these two winches. The check valve 130 and a pressure release valve 132 combine with an internal orifice within valve 114 to prevent cavitation and to permit regeneration upon lowering of the boom.

With the unloading valve 58 in the position shown, all functions of the machine are available for the operator. However, should the hydraulic load on the engine 56 reach a point that the engine is nearing stall, the pressure in pilot passage 64 will increase to the point that internal relief valve 134 will shift, connecting the pilot passage 64 to the reservoir side of the pump. Flow established through orifice 66 will create a pressure drop thereacross, thereby causing the unloading valve 58 to shift to the left. Pressure flow from the pump 52 will be diverted through conduit 70, while conduit 62 is blocked. In effect, the load imposed on the engine by pump 52 will be removed and the engine prevented from stalling. The engine will then be capable of supplying the maximum power called for by the main and auxiliary hydraulic motors 43 and 40, as well as the maximum power required by the swing motor 100. Stalling of the engine is thereby precluded.

A boom hoist limit valve 136 and an override valve 138 are connected in series in a conduit 140 extending from the pilot passage 64 to the reservoir 78. The pilot passage 64 is an internal passage within the block 60 and the conduit is an external conduit connected to the block 60 and communicating with the passage 64. The limit valve 136 is normally shifted to block conduit 140, as shown in FIG. 2, while the override valve 138 is normally open. When the boom reaches the acceptable limit of its angular travel, the limit valve is mechanically shifted opening conduit 140 to permit flow to the reservoir 78. This causes a pressure drop across orifice 66. The difference in forces created on each side of the unloading valve 58 causes it to shift diverting fluid pressure from the pump 52 to the reservoir side through conduit 70 and blocking conduit 62. Operation of the boom hoist is therefore interrupted. The manual override valve 138 permits a reactivation of the boom hoist circuit. By moving this valve manually upward, the conduit 140 will once again be blocked stopping flow through the orifice 66, balancing the pressure forces on each side of valve 58, and permitting the spring 68 to shift the valve 58 once again to the position shown in FIG. 2.

Figure 3:
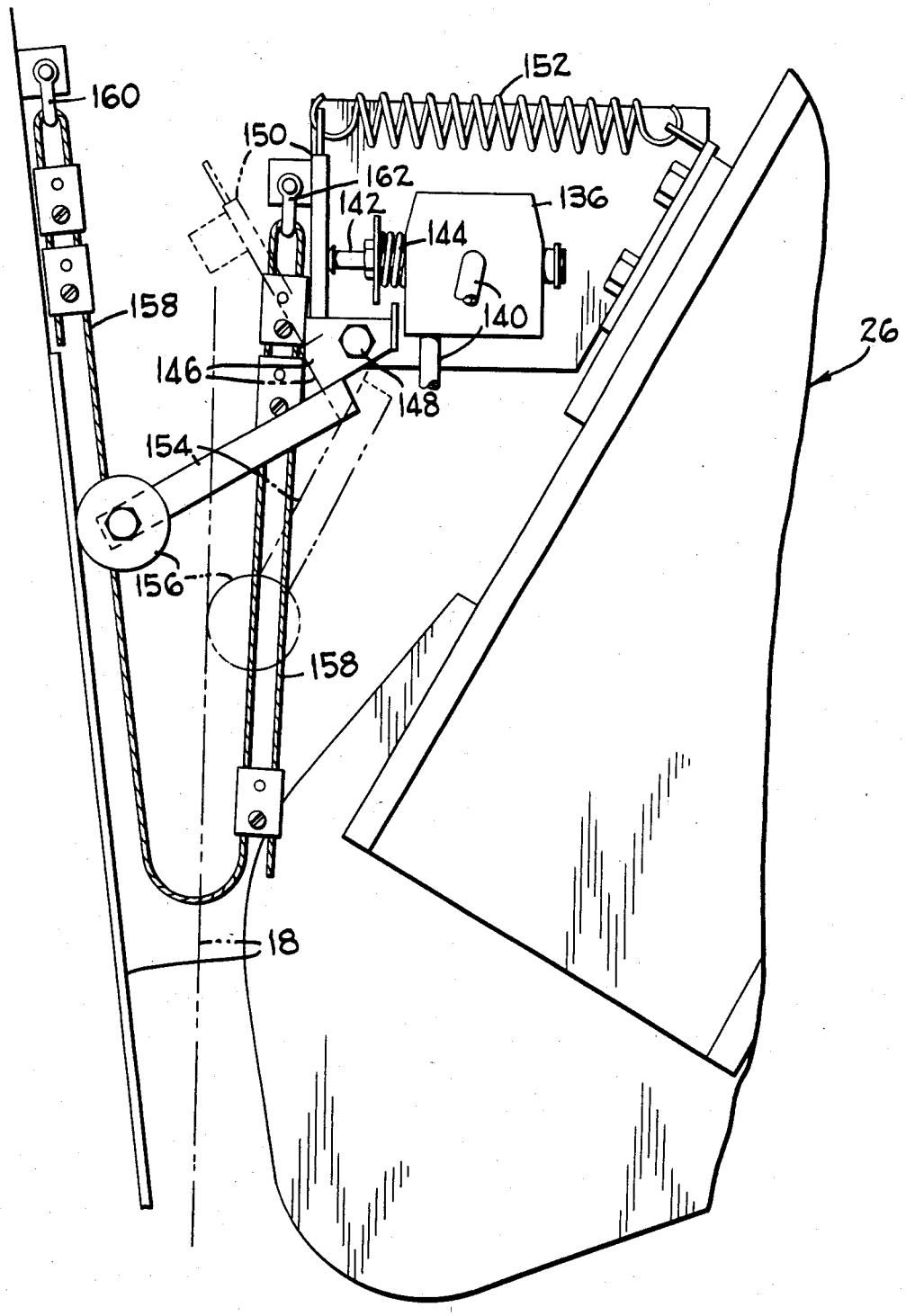
FIG. 3 is a side elevational view of the device for limiting both the raising and lowering of the boom.

FIG. 3 shows a means of automatically actuating the boom limit valve 136. The valve 136 is mounted on a leg of the gantry 26 and includes a spool 142 which is urged outward by compression spring 144. A bell crank 146. is pivotally mounted from the gantry by means of pin 148. The upper arm 150 of bell crank 146 is positioned to engage the spool 142 with a tension spring 152 attached between the free end of arm 150 and the gantry. The tension spring 152 exerts a force to overcome the compression spring 144 and force the spool 142 to an inward position, i.e., to that position for valve 136 illustrated schematically in FIG. 2. The other arm 154 of bell crank 146 extends substantially transverse to the arm 150 with a roller 156 rotatably mounted on its free end. When the boom 18 is raised to a position where stresses in the boom become excessive due to its almost vertical orientation, the boom 18 will engage the roller 56 causing the bell crank 146 to rotate counterclockwise, as viewed in FIG. 3. The upper arm 150 will also rotate causing this spring 152 to extend and permitting the compression spring 144 to urge the spool 142 outward. With the spool outward, the valve 136 is shifted so that flow is established through conduit 140 with the result previously described. A flexible tension member or cable 158 is pivotally attached to the boom by fitting 160 and to upper arm 150 by fitting 162. The cable 158 can transmit only tension and readily folds as the boom 18 is raised. However as the boom is lowered it unfolds so it is taut. This taut position is near the acceptable limit for lowering of the boom 18. As this limit is reached, the cable 158 will have pulled the upper arm 150 away from the spool 142, which again permits the valve 138 to shift to a position in which flow is established through conduit 140. The single valve 136 is, therefore, effective to prevent an operator from inadvertently damaging the crane by exceeding the limits of the boom angle in both directions. It should be noted that the characteristics of the unloading valve 58 in diverting the boom hoist pump 52 are effectively utilized by the present invention not only to prevent the boom from being raised and lowered beyond acceptable limits, but also to preclude the engine from being inadvertently loaded to a stall condition.

While a preferred embodiment of the present invention has been shown and described herein, various changes and modifications may be made therein without departing from the spirit of the invention as defined by the scope of the intended claims.

What is claimed is:

1. A hydraulic circuit for a pedestal mount crane having a boom pivoted on an upper works, main and auxiliary lift hooks suspended from the boom, an engine and a reservoir mounted on said upper works; said circuit comprising:

a lift hook pump and a boom hoist pump driven by said engine;

a boom control valve means connected with said boom hoist pump for controlling upward and downward angular travel of said boom;

an unloading valve means interposed between said boom hoist pump and said control valve means and normally positioned to provide free communication therebetween;

lift hook valve means connected with said lift hook pump for independent control of said lift hooks;

said unloading valve means having a passage provided with an orifice therein connected to said lift hook pump;

a pressure relief valve means for sensing the pressure in said passage and connected to establish flow through said orifice to said reservoir in response to a predetermined pressure in said passage;

means for shifting said unloading valve means from the normal position to an unloading position connecting said boom hoist pump with said reservoir when flow through said orifice is established;

a conduit connecting said passage to said reservoir; a boom travel limit valve means interposed in said conduit and noramlly biased to a closed position in which said conduit is blocked from communicating with said reservoir;

boom actuated means for shifting said boom travel limit valve means to an open position communicating said passage with said reservoir in response to the boom reaching predetermined upward and downward angular limits of travel; and an override valve interposed in said conduit and normally biased to permit flow therethrough to said boom travel limit valve means and movable to a position in which flow therethrough is blocked disrupting communication of said boom travel limit valve means with said reservoir in the open position thereof and the flow through said orifice into said conduit.

2. The hydraulic circuit according to claim 1, wherein said boom actuated means comprises:

a bell crank mounted on said upper works and having one arm biased into engagement with said boom travel limit valve means for holding the same in said closed position;

a roller mounted on the other arm of said bell crank and engageable with said boom at the predetermined angular upper limit of travel for rotating said one arm of said bell crank out of engagement with said boom travel limit valve means causing said boom travel limit valve means to move to its open position; and a felxible tension member having one end connected to said one arm of said bell crank and a second end connected to said boom and of a length that when said boom reaches the predetermined angular lower limit of travel, said tension member will pull said one arm of said bell crank out of engagement with said boom travel limit valve means causing it to move to its open position.

* * * * *